US012692670B2

(12) United States Patent
Almstrom

(10) Patent No.: US 12,692,670 B2
(45) Date of Patent: Jul. 28, 2026

(54) ROADWAY EXPANSION JOINT DEVICE COMPRISING A ROD SUPPORTING A FLEXIBLE ELEMENT PLACED BETWEEN TWO JOINT PROFILES

(71) Applicant: KarlGeir Gruppen AB, Stockholm (SE)

(72) Inventor: Olof Almstrom, Stockholm (SE)

(73) Assignee: KARLGEIR GRUPPEN AB, Stockholm (SE)

( * ) Notice: Subject to any disclaimer, the term of this patent is extended or adjusted under 35 U.S.C. 154(b) by 0 days.

(21) Appl. No.: 19/073,141

(22) Filed: Mar. 7, 2025

(65) Prior Publication Data

US 2025/0198093 A1 Jun. 19, 2025

Related U.S. Application Data

(63) Continuation of application No. PCT/SE2024/050539, filed on May 30, 2024.

(30) Foreign Application Priority Data

Jun. 2, 2023 (SE) ..... 2330253-2

(51) Int. Cl.
*E01C 11/02* (2006.01)
*E01D 19/06* (2006.01)
*E01D 21/00* (2006.01)

(52) U.S. Cl.
CPC ..... *E01C 11/02* (2013.01); *E01D 19/06* (2013.01); *E01D 21/00* (2013.01)

(58) Field of Classification Search
CPC ..... E01C 11/02; E01D 19/06; E01D 21/00
(Continued)

(56) References Cited

U.S. PATENT DOCUMENTS 2,043,571 A * 6/1936 Bargreen ..... E01C 11/14 404/60
2,149,291 A * 3/1939 Hofwolt ..... E01C 11/14 404/60

(Continued)

FOREIGN PATENT DOCUMENTS

CN 207727423 U 8/2018
CN 109235256 B 4/2020

(Continued)

OTHER PUBLICATIONS

Swedish Intellectual Property Office, Stockholm, Sweden, Final Notice of Allowance, Jan. 20, 2025.

(Continued)

*Primary Examiner* — Raymond W Addie
(74) *Attorney, Agent, or Firm* — Noréns Patentbyrå AB

(57) ABSTRACT

A roadway expansion joint device comprising two joint profiles placed at a distance from each other. Each profile comprises at least one upwards extending leg having at least one through hole. A pipe extends from at least one of the through holes and at least one supporting rod is provided, which fits inside and extends out from at least one of the pipes in one of the profiles. The supporting rod supports a flexible element, which is placed between the two joint profiles. The device can be used for any types of constructions joining different type of roadway parts to solve problems with bearing capacity of the flexible element while at the same time having a joint with the possibility of compensating for and taking up movements, while having a low total weight.

9 Claims, 6 Drawing Sheets

(58) Field of Classification Search
USPC ..... 404/47–60
See application file for complete search history.

(56) References Cited

U.S. PATENT DOCUMENTS

| | | | | | |
|---|---|---|---|---|---|
| 2,158,953 | A * | 5/1939 | Wilcox | E01C 11/14 | 404/60 |
| 2,181,005 | A * | 11/1939 | Westcott | E01C 11/14 | 404/60 |
| 2,186,104 | A * | 1/1940 | Taubensee | E01C 11/14 | 404/60 |
| 2,194,718 | A * | 3/1940 | Older | E01C 11/14 | 404/60 |
| 2,197,768 | A * | 4/1940 | Pier | C10M 101/02 | 422/186.04 |
| 2,197,786 | A * | 4/1940 | Capouch | E01C 11/12 | 404/60 |
| 2,299,670 | A * | 10/1942 | Westcott | E01C 11/14 | 404/60 |
| 2,319,050 | A * | 5/1943 | Fischer | E01C 11/14 | 404/62 |
| 2,321,087 | A * | 6/1943 | Jacobson | E01C 11/14 | 404/63 |
| 2,325,472 | A * | 7/1943 | Brickman | E01C 11/14 | 404/60 |
| 2,358,328 | A * | 9/1944 | Heltzel | E01C 11/126 | 404/59 |
| 2,365,550 | A * | 12/1944 | Heltzel | E01C 11/14 | 404/62 |
| 2,572,552 | A * | 10/1951 | Willard | E01C 11/14 | 404/60 |
| 2,575,247 | A * | 11/1951 | Carter | E01C 11/14 | 404/60 |
| 2,577,997 | A * | 12/1951 | Carter | E01C 11/14 | 404/13 |
| 2,858,748 | A * | 11/1958 | Crone | E01C 11/14 | 404/59 |
| 3,606,826 | A | 9/1971 | Bowman | | |
| 3,732,021 | A | 5/1973 | Rizza et al. | | |
| 3,880,540 | A * | 4/1975 | Rizza | E01D 19/062 | 404/69 |
| 3,881,833 | A * | 5/1975 | McMullen | E01C 11/14 | 404/60 |
| 3,974,614 | A * | 8/1976 | Strong | E04B 1/6815 | 14/73.1 |
| 4,516,876 | A * | 5/1985 | Wicks | E01C 11/14 | 52/378 |
| 4,648,739 | A * | 3/1987 | Thomsen | E01C 11/14 | 404/49 |
| 4,674,912 | A | 6/1987 | Buckenauer | | |
| 4,834,576 | A * | 5/1989 | Argento | E01C 11/14 | 404/69 |
| 5,216,862 | A * | 6/1993 | Shaw | E04B 1/483 | 52/704 |
| 5,586,834 | A * | 12/1996 | Tsuji | E01C 11/14 | 404/62 |
| 5,674,028 | A * | 10/1997 | Norin | E01C 11/14 | 404/74 |
| 7,252,454 | B2 | 8/2007 | Bradford et al. | | |
| 7,441,984 | B2 * | 10/2008 | Kramer | E01C 11/14 | 404/62 |
| 8,496,398 | B2 * | 7/2013 | DiPietro | B28B 23/005 | 404/62 |
| 8,591,139 | B2 * | 11/2013 | Gibson | B29C 70/021 | 404/59 |
| 2006/0177269 | A1 * | 8/2006 | Kramer | E01C 11/14 | 404/60 |
| 2006/0204329 | A1 * | 9/2006 | Costa | E01C 11/14 | 404/60 |
| 2013/0202355 | A1 * | 8/2013 | Gibson | B29C 69/001 | 404/59 |

FOREIGN PATENT DOCUMENTS

| | | | |
|---|---|---|---|
| CN | 112239999 | A | 1/2021 |
| EP | 0325737 | B1 | 4/1992 |
| EP | 2483477 | B1 | 8/2012 |
| EP | 2959060 | B1 | 12/2015 |
| EP | 3426854 | B1 | 1/2019 |
| KR | 101761476 | B1 | 7/2017 |
| WO | 02090661 | A1 | 11/2002 |

OTHER PUBLICATIONS

Swedish Intellectual Property Office, Stockholm, Sweden, International Search Report, Jun. 25, 2024.

* cited by examiner

ROADWAY EXPANSION JOINT DEVICE COMPRISING A ROD SUPPORTING A FLEXIBLE ELEMENT PLACED BETWEEN TWO JOINT PROFILES

The present invention refers to a roadway expansion joint device which device can be used between two bridge constructions or between a bridge construction and an adjacent roadway or in other types of constructions joining different type of roadway parts, for example parking facilities.

Roadway expansion joints is typically a joint between two construction panels, such as roadways, sideways and precast structures. A joint construction in general, is normally assembled in place between two existing bridge parts, or road parts. An expansion joint typically has a shorter lifespan than the actual bridge parts or road parts and thus needs to be maintained or replaced.

An expansion joint must also be drivable and withstand the load of heavy and intensive vehicle traffic, and preferably be maintenance-free to the greatest extent possible.

A roadway expansion joint device should absorb movements from the surrounding structure, both compression and expansion as well as vertical movements. Roadway expansion joints are subject to damage over time due to for example wear, environmental factors, mechanical movements, building settling or seismic activity and shrinkage due to temperature fluctuations.

The roadway expansion joint device must also seal against surrounding parts. A leaking joint causes frost blasts in the concrete structure and thus has devastating effects through reduced bearing capacity and service life.

Different types of bridging expansion joint devices used to join roads and bridge constructions are known from the prior art.

In order to accommodate larger movements, e.g., 100 mm and more, some prior art uses longitudinal transverse beams, often in a beam box, embedded in the bridge structure, supporting one or more rail profiles, which in turn holds a sealing elastomeric part. In some prior art like U.S. Pat. Nos. 3,880,540 and 3,732,021. Both showing the use of springs, here between the rail profiles. Others prior arts are U.S. Pat. Nos. 3,606,826, 4,674,912, 7,252,454 and WO 02 09 0661 A1.

These rails, beams and beam boxes are most often made of steel and therefore extremely heavy, which places high demands on lift devices.

EP 3 426 854 describes an expansion joint seal for surface contact applications, a shock absorption system including a compression spring inserted in the compressible foam sealant, may be encapsulated within a cylindrical housing. Disadvantages with this type of solution is for example limitations for larger movements in the construction.

Other prior art is for example EP 2 959 060 which describes a roadway expansion joint device having a rod casted and fixated inside. This type of roadway joint device joint device includes a rod and pipe and is not adapted to be span between two bridge decks since the rod and the enclosure pipe are mounted on one side of the bridge deck, not spanning between the bridge decks, and where using the enclosure pipe, respective spaces between the rod and an inner surface of the surrounding enclosure pipe is filled with grout mortar and is thereby fixed.

Another type of joint device is described in EP 2 483 477 which describes a device for bridging an expansion joint wherein the device is described to be able to comprise a compression spring. This spring is however casted and fixed inside the device and its purpose is to prevent a stabilizer element from popping out of the casting. A liquid mass is then poured on top which must solidify in place.

Yet another prior art is shown in KR 101761476B1 where an elastic bar on each side of the joint is mounted and a non-attaching pipe, covering just a certain section, is threaded over the elastic bars on each side, and has a certain non-attaching section between this high-performance sponge material.

It is well known that building elements and specially bridges, must renovates over time or even replaced due to damage from corrosion to the steel reinforcement, which leads to a destruction of the concrete structure. In recent times, in connection with the renovation of old concrete structures, steel reinforcement and other materials has begun to be replaced with fibreglass and carbon fibre reinforcements.

The roadway expansion joint device according to this invention solves problems with bearing capacity of the flexible element while at the same time having a joint with the possibility of compensating for and taking up movements and is also sealing, while having a low total weight.

SUMMARY OF THE INVENTION

According to a first aspect of the invention a roadway joint device comprising two joint profiles, wherein each joint profile comprises a first profile and a second profile, placed at a distance from each other. Each profile comprises at least one upwards extending leg, in a vertical direction from a straight plane and at least one through hole in the first upwards extending leg. A pipe extends from at least one of the through holes in the upwards extending leg. At least one supporting rod is provided, which supporting rod fits inside and extends out from at least one of the pipes in the first upwards extending leg of one of the profiles and continues into the pipe in the second profile or, when only one of the upwards extending legs is provided with a through hole, ends at the upwards extending leg of the other profile. The supporting rod supports a flexible element, which is placed between the two joint profiles.

According to one embodiment, the joint profiles are L-shaped profiles, wherein each L-shaped profile have a first upwards extending leg, in a vertical direction from a straight plane, a horizontal part extending out from the upwards extending led so that an L-shape is formed.

According to another embodiment, the joint profiles are U-shaped profiles wherein each U-shaped profile have a first upwards extending leg, in a vertical direction from a straight plane, an intermediate horizontal part and a second upwards extending leg. At least one of the U-shaped profiles comprises at least one through hole in the first upwards extending leg of the U-shaped profile, and at least one through hole in the second upwards extending leg of the U-shaped profile. The pipe extends from at least one of the through holes in the first upwards extending leg of either one of the U-shaped profiles and continues into the through hole of the second upwards extending leg of the U-shaped profile.

According to another embodiment the roadway expansion joint device further comprises a spring element arranged inside at least one of the pipes.

According to a further embodiment, the pipes preferably have a circular cross section.

According to another embodiment each pipe has a diameter that is 1.5 times larger than the diameter of the supporting rod.

According to a further embodiment, the pipes is cone-shaped in the longitudinal direction of the pipe.

According to another embodiment the profiles are made of a composite material, carbon fibre, glass fibre reinforced plastic or a metal.

According to another embodiment the flexible element is made of solid motion-absorbing material.

According to another embodiment the pipe(s) and the supporting rod is made of a composite material, carbon fibre or glass fibre reinforces plastic.

According to a second aspect of the invention, the roadway joint device according to any of the embodiments are used to join two bridge parts.

SHORT DESCRIPTION OF DRAWINGS

The present invention will now be described in more detail under the referral to the attached drawings, in which.

DETAILED DESCRIPTION

Figure 1A:
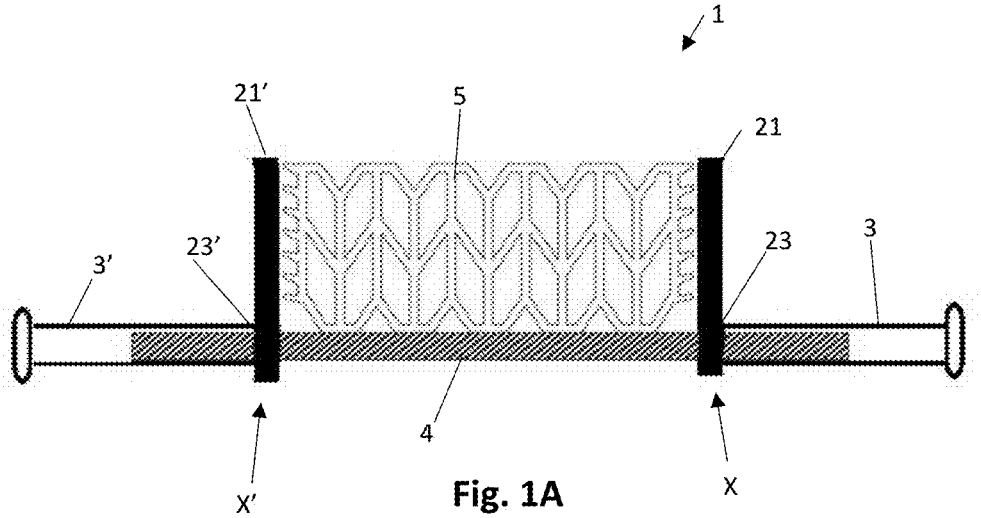
FIG. 1A shows a front view of first embodiment of a roadway expansion joint device, having a first embodiment of joint profiles.
Figure 1B:
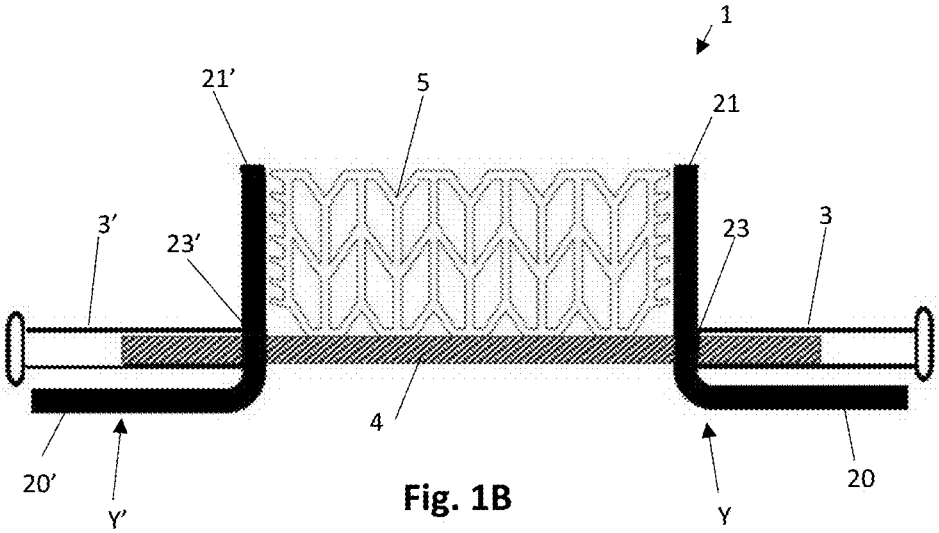
FIG. 1B shows a front view of first embodiment of a roadway expansion joint device, having a second embodiment of joint profiles.
Figure 1C:
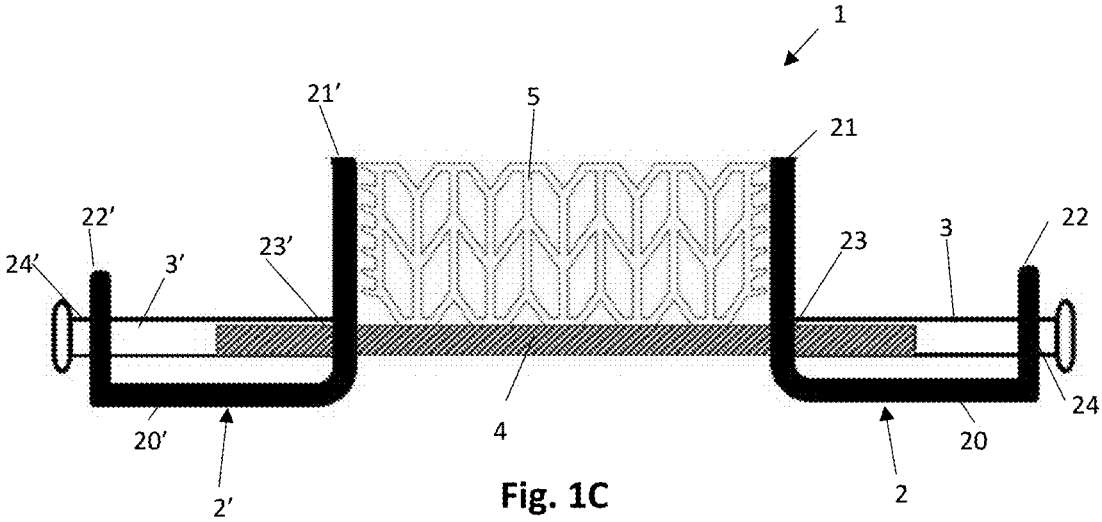
FIG. 1C shows a front view of first embodiment of a roadway expansion joint device, having a third embodiment of joint profiles.

In FIG. 1A-1C a roadway expansion joint device 1 is shown having three different embodiments of the joint profile. In all embodiments, each joint profile comprises a first profile and a second profile, placed at a distance from each other. The different embodiments described in this description can be combined with each other in many different ways. It is also possible to combine different types of profiles within the same device.

FIG. 1A shows a roadway joint device wherein the joint profiles are straight, I-formed, profiles. The roadway expansion joint device 1 comprises two joint I-shaped profiles, a first I-shaped profile X and a second I-shaped profile X', placed at a distance from each other. Each I-shaped profile X,X' have a first upwards extending leg 21,21', which extends upwards in a vertical direction from a straight plane. At least one of the I-shaped profiles comprises at least one through hole 23,23' in the upwards extending leg 21,21'.

A pipe 3,3' extends from the at least one of the through hole 23,23' in the upwards extending leg 21,21', facing away from the other I-shaped profile.

At least one supporting rod 4 is provided, which supporting rod fits inside and extends out from at least one of the pipes 3,3' in the first upwards extending leg 21,21' of one of the profiles X,X' and continues into the pipe 3,3' in the second profile or, when only one of the upwards extending legs is provided with a through hole, ends at the upwards extending leg 21,21' of the other profile 2,2', which supporting rod 4 supports a flexible element 5, which is placed between the two joint profiles 2,2'.

The supporting rod can move freely inside the pipe, it is not attached at any end to the pipe or other parts of the device, i.e it is a detached supporting rod. One purpose of having the supporting rod 4 detached inside pipe 3 is to be able to adapt the desired total movement ability within the device, which is determined during the design, by dimensioning both the length of the pipes and the rods and the diameter of the pipes. With this construction, projected movements and loads can be taken up even with larger gap widths and thereby greater expected movement. As mentioned below, the pipes 3 can also be adapted in different ways. This achieves a significantly greater range of motion than if the supporting rod would be fixed.

FIG. 1B shows a roadway joint device wherein the joint profiles are L-shaped. The roadway expansion joint device 1 comprises two joint L-shaped profiles, a first L-shaped profile Y and a second L-shaped profile Y', placed at a distance from each other, with the upwards part of the L facing each other. Each L-shaped profile 2,2' have a first upwards extending leg 21,21', which extends upwards in a vertical direction from a straight plane, and a horizontal part 20,20' extending out from the upwards extending leg 21,21' so that an L-shape is formed.

The horizontal part 20,20' of the profile adds stability to the profile and gives more possibilities for attachment in each bridge/road part.

A hollow pipe 3,3' extends from the at least one of the through hole 23,23' in the upwards extending leg 21,21', facing away from the other I-shaped profile. The pipe 3,3' has a circular cross section.

At least one supporting rod 4 is provided, which supporting rod fits inside and extends out from at least one of the pipes 3,3' in the first upwards extending leg 21,21' of one of the profiles Y,Y' and continues into the pipe 3,3' in the second profile or, when only one of the upwards extending legs is provided with a through hole, ends at the upwards extending leg 21,21' of the other profile 2,2', which supporting rod 4 supports a flexible element 5, which is placed between the two joint profiles 2,2'.

FIG. 1C shows a roadway joint device wherein the joint profiles are U-shaped profiles. The roadway expansion joint device 1 comprises two joint U-shaped profiles, a first U-shaped profile 2 and a second U-shaped profile 2', placed at a distance from each other. Each U-shaped profile 2,2' have a first upwards extending leg 21,21', which extends upwards in a vertical direction from a straight plane, and a second upwards extending leg 22,22', which extends upwards in a vertical direction from a straight plane, and an intermediate horizontal part 20,20' in between so that the U-shape is formed.

The U-shaped profiles 2,2' have at least one through hole in each of the upwards extending legs. At least one first through hole 23,23' is provided in the first upwards extending leg 21,21' of the U-shaped profile 2,2' and at least one second through hole 24,24' is provided in the second upwards extending leg 22,22' of the U-shaped profile 2,2'. A hollow pipe 3,3' extends at least from the first through hole 23,23' in the first upwards extending leg 21,21' of each U-shaped profile 2,2' and into the through hole 24,24' of the second upwards extending leg 22,22' of the U-shape profile 2,2'. The pipe 3,3' can either be arranged so that at least one end of the pipe 3,3' ends inside one of the legs of the U-shaped profile 2,2' (not shown), or with the pipe extending through and out on the other side of the second upwards extending leg 22,22', as shown in FIGS. 1C-9.

The first through hole 23,23', in the first upwards extending leg, and the second through hole 24,24', in the second upwards extending leg, is preferably, but not necessarily, arranged at corresponding heights on the upwards extending legs.

The two U-shaped profiles 2,2' are arranged at a distance from each other, and a supporting rod 4 is provided inside the pipe 3 attached in the first U-shaped profile 2 and extends into the pipe 3' that is attached in the second U-shaped profile 2'. The supporting rod 4 serves as a support for a flexible element 5 which is placed between the two joint U-shaped profiles 2,2', above the supporting rod 4.

The hollow pipe 3,3' can for example be made of a composite material, carbon fibre or glass fibre reinforced plastic (GRP). An advantage of using a composite material is that composite has a low weight, takes up little space and is stronger than steel. These composites are artificially composed materials, where the constituent materials together form a structural material. For these products, the collective term FRP, (Fibre Reinforced Polymers) is most often used. The FRP has excellent resistance to moisture and chemicals over a large temperature range. It does not rust, rot, corrode or swell. It is durable and has a long working life, is also requires less energy for production as compared to steel components. These reinforced polymers usually consist of either carbon fibre, fibreglass, or various combinations of carbon and fibreglass. Carbon fibre's unique properties make it an ideal structural material for various applications in numerous industries. Rigidity, strength, and fatigue resistance are some of the beneficial properties of carbon fibre. Composites containing carbon fibre are twice as stiff and five times stronger than steel per unit weight. Carbon fibre also has better fatigue properties and corrosion resistance than most materials including high-strength steel alloys. Also, carbon fibre does not suffer from the thermal expansion of common metals like steel or aluminum, which makes it an ideal, alternative building material in the construction that are to be used in challenging environments.

Another advantage of using a composite material, carbon fibre or GRP is that it contributes to a reduced environmental impact compared to steel structures. It has a low weight which also allows quick assembly on site, whereas the dominant steel joints on the market today are heavy and require lifting devices. A further advantage is that it is easy to make any adjustments on site, e.g. set the current joint width or dimensional adaptations, which is much harder to do with a steel construction.

The use of these composite materials further eliminates the risk of corrosion. This can drastically reduce the number of repairs needed.

The distance between the two profiles 2,2' is adapted to the width of the joint gap.

Figure 2:
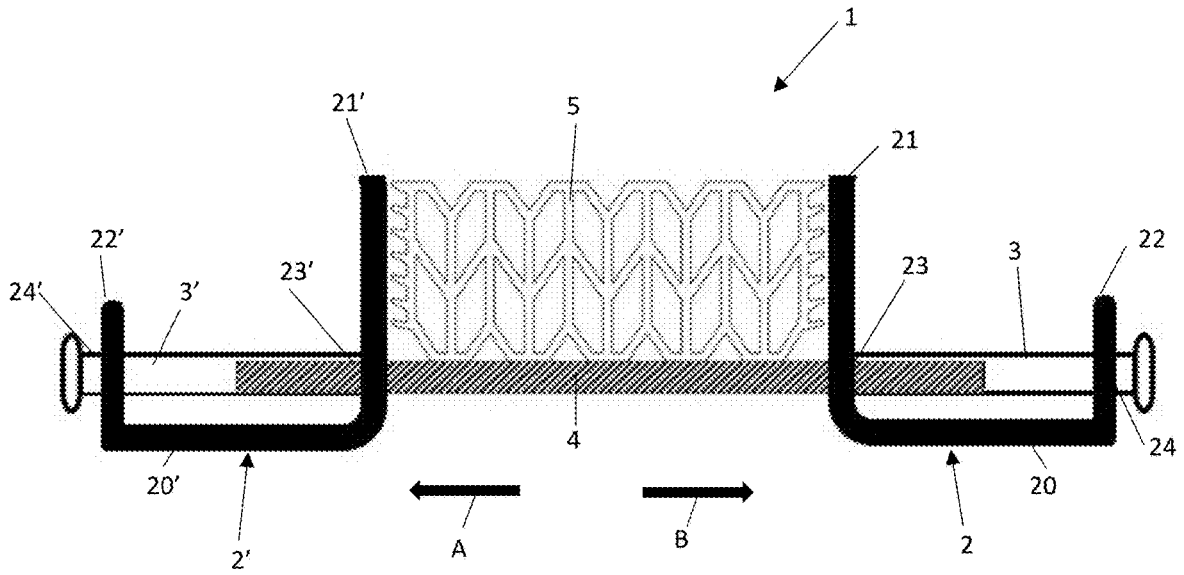
FIG. 2 shows a front view of first embodiment of a roadway expansion joint device.

The supporting rod 4 can move freely inside the pipes 3,3' in horizontal direction, as shown by the arrows A and B in FIG. 2. The diameter of the pipe 3,3' is larger than the diameter of the supporting rod 4, which also allows the supporting rod 4 to move slightly in vertical direction inside the pipe 3,3'. This compensates for shearing and prevents damages to the joint as well as the bridge/road part. The inner diameter of the pipes 3,3' is preferably slightly larger than the diameter of the supporting rod 4. In some embodiment the inner diameter of the pipes 3,3' is about 1.5 times the diameter of the supporting rod 4, but also other diameters can be used as long as the supporting rod fits and is movable inside the pipe. The length of each supporting rod 4 can be adapted to the current joint width, by cutting (or appropriate method) the supporting rod 4 to the appropriate length during installation. The supporting rod 4 must be long enough so that it cannot fall out from the pipes 3,3'. The diameter of the through holes 23,23' and 24,24' is adapted so that the pipes 3,3' can fit inside the through holes.

The supporting rod 4 can preferably be made of a composite material, carbon fibre or glass fibre reinforced plastic. An advantage of using a composite material is that composite has a low weight, takes up little space and is stronger than steel. The composites and advantages of their use are described more in detail above with reference to the hollow pipe. The supporting rod is however solid, not hollow.

The flexible element 5 is made of a solid motion-absorbing material, to absorb movement from vehicles passing over the device 1. Non-limiting examples of such materials is rubber of EPDM or Chloroprene of preferably 85 shore A degree but can also be of closed cell, crosslinked sponge material such as Physite 380® or EV50®. The flexible element is arranged to be attached on both sides chemically to the upwards extending legs of the profiles, preferably with epoxy, epoxy resin or by mechanically means.

The profiles can, like the pipes and the supporting rod, be made of a composite material, carbon fibre or glass fibre reinforced plastic, which significantly reduces the weight of the device compared to existing systems. However, it is also possible to make the profiles of a metal such as steel or aluminium. The profiles, pipes and supporting rod can either be made of the same material or of different materials.

The roadway expansion joint device 1, according to any of the embodiments described herein is to be used in a joint gap, between two bridge parts, between to road parts or between a road part and a bridge part. The joint gap can have different widths depending on the construction and the expected movements. Wide joint plates require support for the movement-absorbing part, which is preferably a soft part, in this description the flexible element 5.

The height of each of the first and second upwards extending leg can be varied and can have the same or different height. The height of the legs in one profile 2,2' may also be different from the height of the legs of another profile 2,2'. It is however important that the height of each first upwards extending leg 21,21', closest to the flexible element 5, have a height corresponding essentially at least to the height of the flexible element 5 so that the flexible element is fully supported on both sides.

Figure 7:
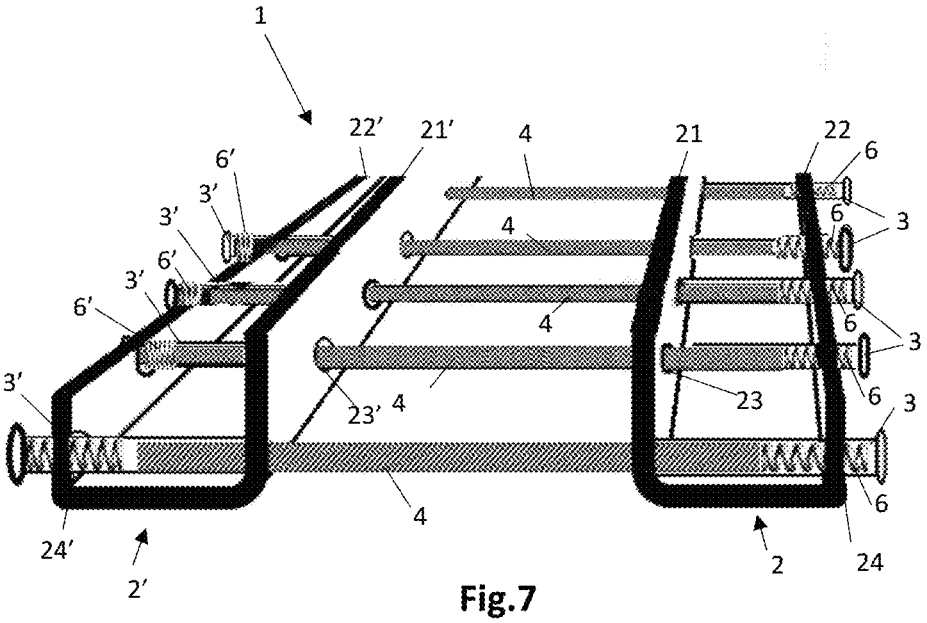
FIG. 7 shows a perspective view of the seventh embodiment of a roadway expansion joint device.
Figure 8:
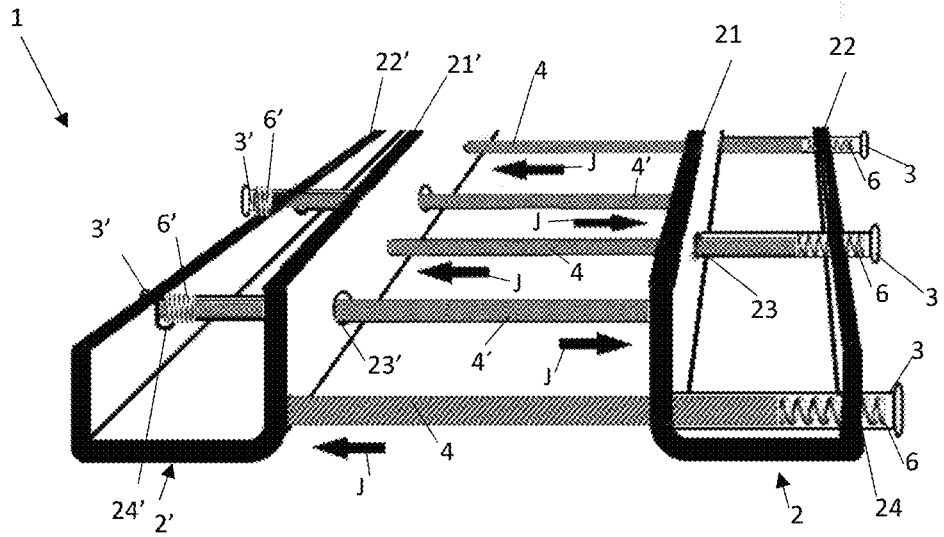
FIG. 8 shows a perspective view of an eight embodiment of a roadway expansion joint device.
Figure 9:
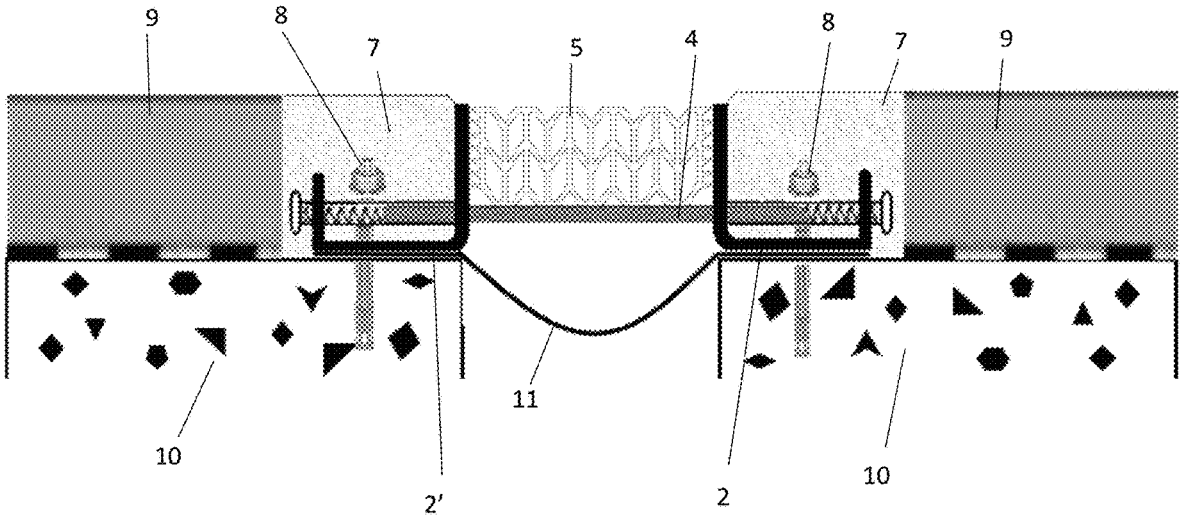
FIG. 9 shows a front view of an embodiment of a roadway expansion joint device mounted into bridge slabs.

A roadway expansion joint device 1 is typically a module of two profiles 2,2' having a specific length, which length is chosen to correspond to the construction in which the device 1 is to be used, which is best shown in FIGS. 7-9 and described further below.

Figure 3:
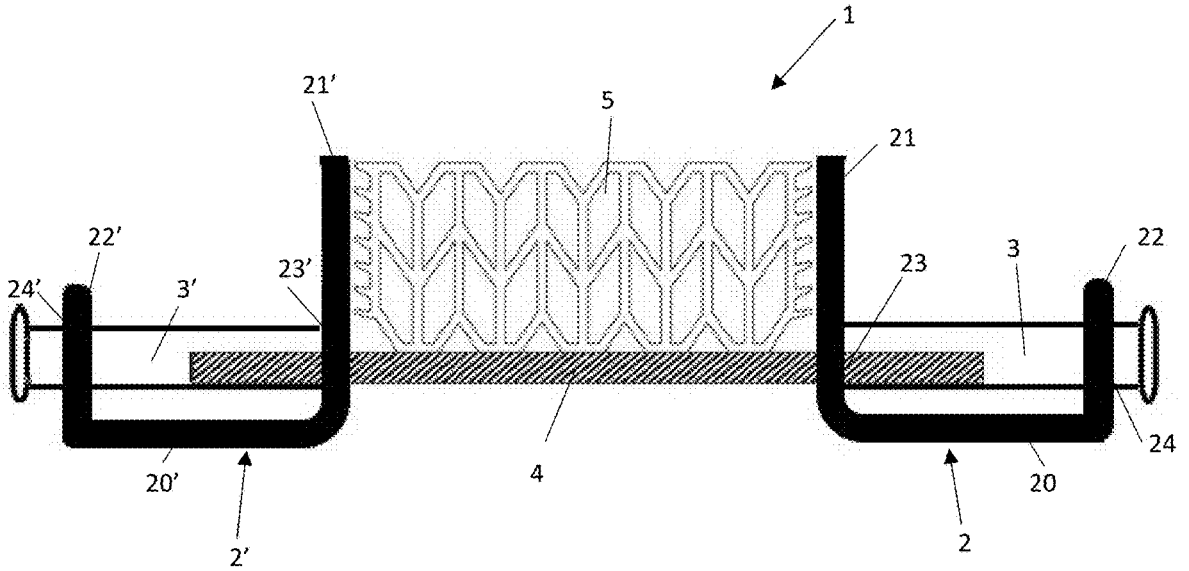
FIG. 3 shows a front view of a second embodiment of a roadway expansion joint device.

FIG. 3 shows another embodiment of a roadway expansion joint device 1, possible to combine with the features of any of the other embodiments described herein, where the pipe 3,3' have a larger diameter i.e., the pipe is wider. This has the effect that larger vertical movements of the supporting rod 4 inside the pipe 3,3' is allowed, as compared to the embodiments in FIGS. 1A-C and 2, where a pipe with smaller diameter is used, which only allows for small vertical movements. This can be an advantage in for example bridge construction where the two parts that are to be joined together using the roadway expansion joint device 1 can move vertically in relation to the other without damaging the roadway or roadway expansion joint device 1. As described above, the supporting rod 4 can move in horizontal direction inside the pipes 3,3'.

Figure 4:
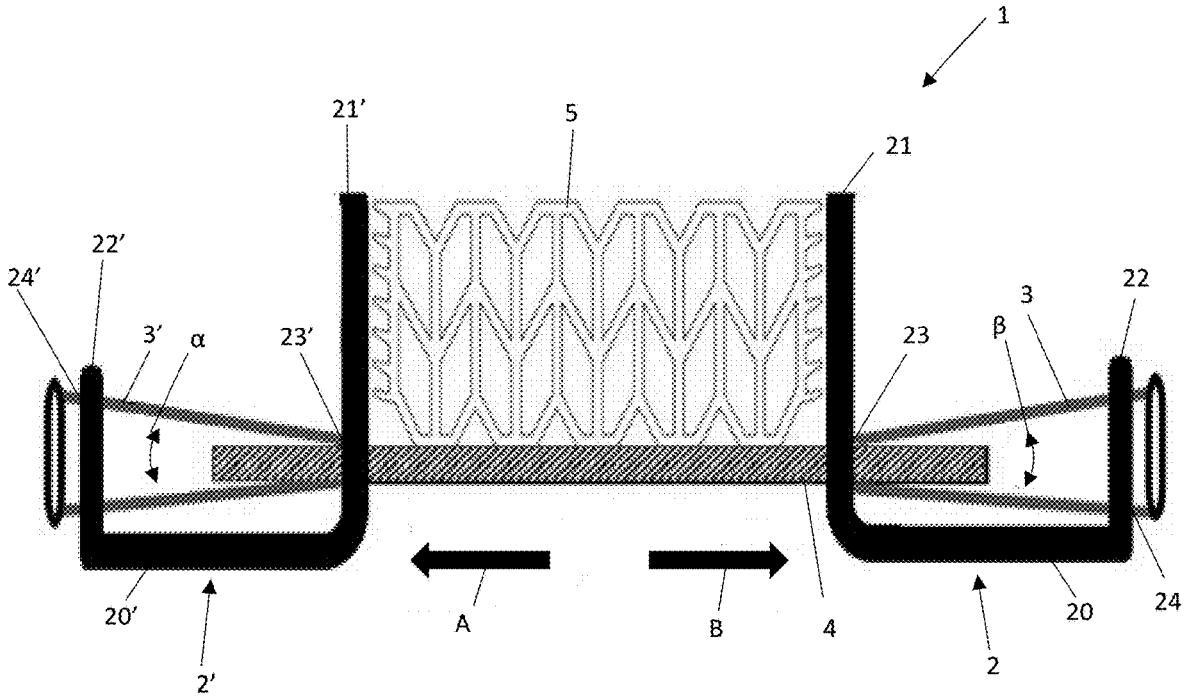
FIG. 4 shows a front view of a third embodiment of a roadway expansion joint device.

FIG. 4 shows another embodiment of a roadway expansion joint device 1, wherein the embodiment described above have been provided with a pipe 3,3' which has a is cone-shape in the longitudinal direction of the pipe 3,3'. This embodiment is possible to combine with the features of any of the other embodiments described herein. The profile used can be any of the profiles described herein, even though a U-shaped profile is preferred since it will give more support to the cone-shaped pipe when the cone-shaped pipe is supported in both of the upwards extending legs of the profile.

In embodiments where a U-shaped profile is used, the cone-shaped pipe 3,3' is provided so that the end of the cone having a smaller diameter is attached to the first through hole 23,23' in the first upwards extending leg 21,21' of the U-shaped profile 2,2', the pipe 3,3' extend through the second through hole 24,24' in the second upwards extending leg 22,22' of the U-shaped profile 2,2' and the end of the cone-shaped pipe 3,3' having a larger diameter ends on the outside of the second upwards extending leg 22,22' of the U-shaped profile 2,2'. Although shown herein with both pipes 3,3' having a cone-shaped end, it is also possible to have one pipe 3 having a cone-shaped end and the other pipe 3' having a circular cross section. In cases where an L-formed profile is used, the cone-shaped pipe 3,3' is provided so that the end of the cone having a smaller diameter is attached to the first through hole 23,23' in the first upwards extending leg 21,21' of the L-profile. The use of an L-or I-shaped profile in combination with the cone-shaped pipe will place a greater demand on the assembly of the roadway expansion joint device to ensure that the protruding pipe does not bend.

The cone-shaped pipe 3,3' allows further vertical movements in the device, as the supporting rod 4 can move freely up and down inside the cone shaped pipe 3,3' during any vertical movement, as shown by the arrows $\alpha$ and $\beta$ in FIG. 4 and described above with reference to FIG. 3 and also further below with reference to FIGS. 6A-C. The supporting rod 4 can also move in horizontal direction inside the pipe 3,3' as described in the embodiments above.

Figure 5:
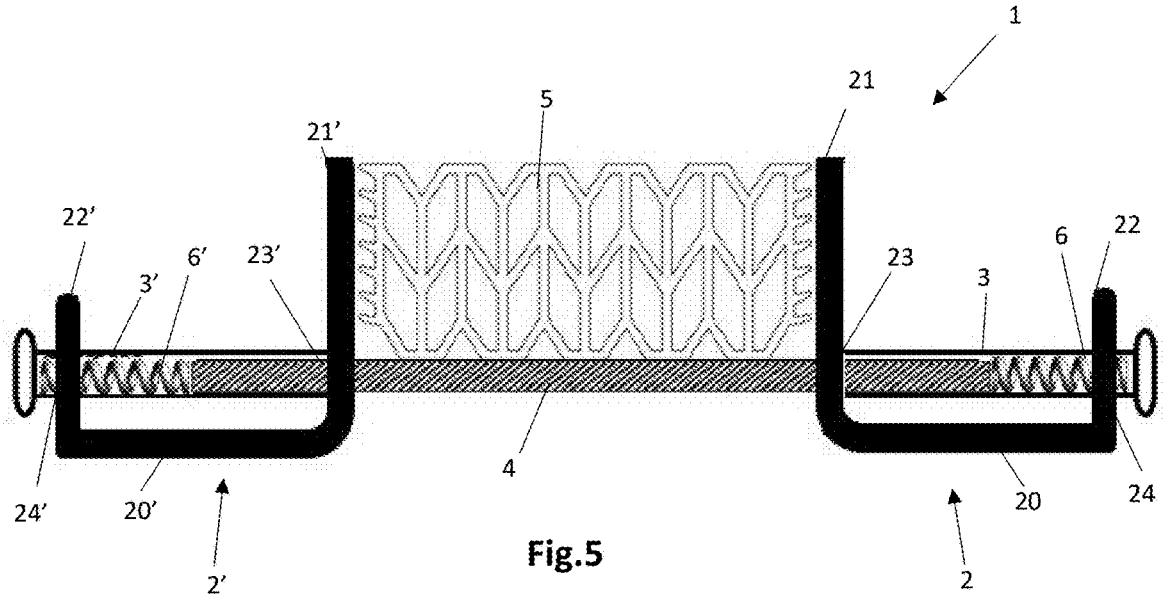
FIG. 5 shows a front view of a fourth embodiment of a roadway expansion joint device.

FIG. 5 shows another embodiment of a roadway expansion joint device 1, possible to combine with the features of any of the other embodiments described herein, wherein a spring element 6,6' is arranged inside each of the pipes 3,3'. Although shown herein in both the pipes 3,3', it would also be possible to add a spring element 6,6' to the pipe 3,3' in only one of the profiles 2,2', while the other profile 2,2' do not have a spring element 6 inside the pipe 3,3'. The spring element 6,6' will provide a constant force to the end(s) of the supporting rod 4, which has the effect that the supporting rod 4 can be centred within the pipe 3,3' at all times, even if height differences occur between the two bridge/road sections. The length of the supporting rod is adapted so that the supporting rod can move freely inside the pipes 3,3 between the spring elements 6,6'. This is specially an advantage in new constructions, where the conditions are often that each bridge side is cast on separate occasions, which is why fitting the supporting rod 4 to the respective pipe could be difficult. Each supporting rod 4 is under constant pressure against the opposing profile of the pressure from the spring element 6 in its rear part. The spring element(s) can also be mounted on the end(s) of the supporting rod 4.

Figure 6A:
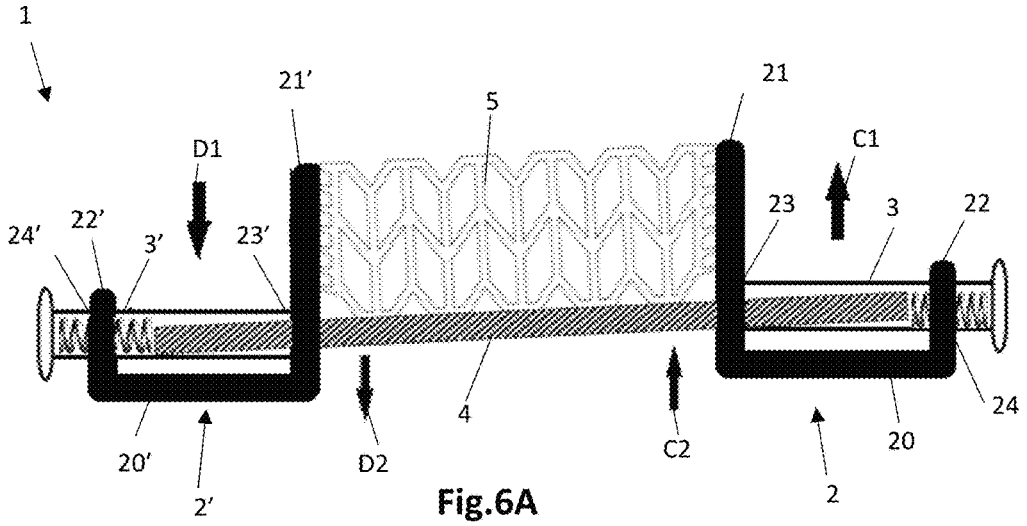
FIG. 6A shows a perspective view of a fifth embodiment of a roadway expansion joint device during possible sheer movement.
Figure 6B:
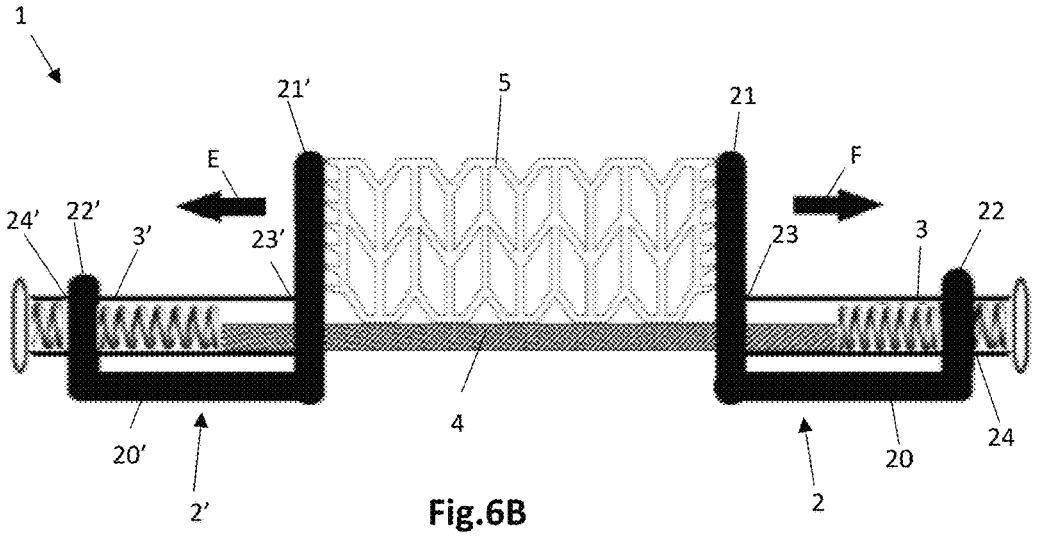
FIG. 6B shows a perspective view of a sixth embodiment of a roadway expansion joint device during expansion.
Figure 6C:
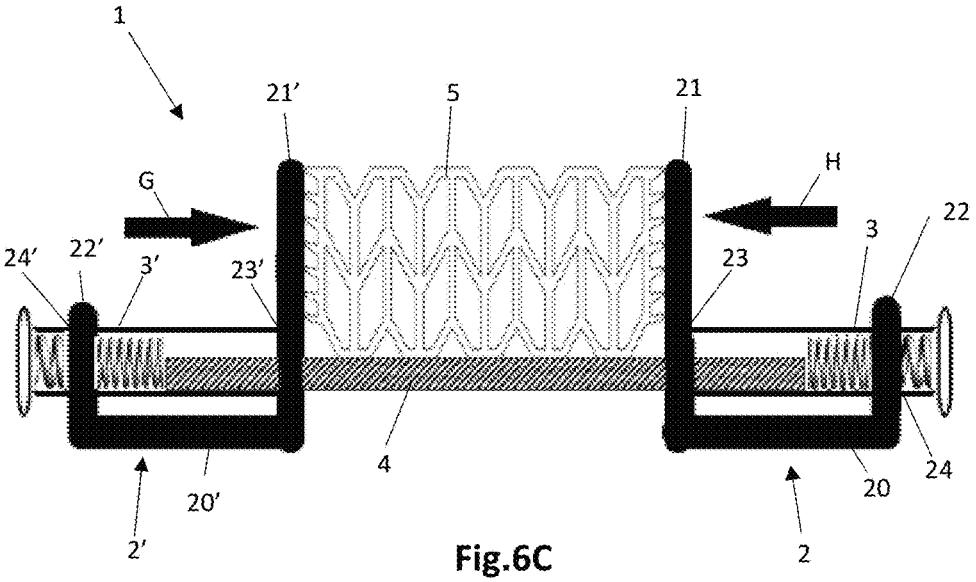
FIG. 6C shows a front view of a seventh embodiment of a roadway expansion joint device during compression.

FIGS. 6A-C shows examples of what happens to the device when movements in the bridge parts, or in one bridge part, occurs. In these figures, the embodiment according to FIG. 3 has been used in combination with a spring element 6 to show the movement of the supporting rod 4 inside the pipes 3,3'. It is to be noted that any of the embodiments shown herein will work in the same way. For FIG. 6A, the spring element is not necessary, however for the effect of FIG. 6B and C any of the embodiments comprising a spring element 6 will function. Although this is only shown for U-shaped profiles in the figures, the same movement can occur in profiles of any shape and the spring element can be used with any profile.

FIG. 6A shows possible movement of the U-shaped profiles 2,2' in the roadway expansion joint device 1 during sheer movements in the bridge or roadway. As can be seen in this figure, the first of the U-shaped profiles 2 is higher up than the second U-shaped profile 2'. This movement is shown by the arrows A and B. The supporting rod 4 will in this case be angled upwards in the end closer to the first U-shaped profile 2, as shown by the arrows C1 and C2, while the other end of the supporting rod 4, closer to the second U-shaped profile 2' is pressed downwards, as shown by the arrows D1 and D2. The person skilled in the art understands that the movement can also occur in the other direction, so that the first U-shaped profile 2 is pressed down/moves downwards and the second U-shaped profile 2' is pressed/moves upwards.

FIG. 6B shows possible movement of the U-shaped profiles 2,2' in the roadway expansion joint device 1 during expansion, i.e., the two U-shaped profiles 2,2' move further away from each other, in horizontal direction, as a consequence of that the distance between the two road/bridge parts becomes larger, in the direction of the arrows E and F.

FIG. 6C shows possible movement of the U-shaped profiles 2,2' in the roadway expansion joint device 1 during compression, i.e., the two U-shaped profiles 2,2' are pressed closer towards one another, in horizontal direction, as a consequence of that the distance between the two road/bridge parts becomes smaller, in the direction of the arrows G and H. Here it can also be seen that the spring elements 6,6' are compressed.

FIGS. 7 and 8 shows a perspective view of the device 1, wherein each profile is an elongated profile comprising several through holes after each other with a supporting rod provided in each through hole and into the pipes 3,3'. The centre-to-centre distance between the supporting rods 4 is preferably approx. 100 mm, but also other distances can be used. Although this is only shown for U-shaped profiles, the person skilled in the art understands that also other profiles can be used, such as for example I-shaped and L-shaped profiles.

FIG. 7 shows a perspective view of an embodiment of a roadway expansion joint device where each U-shaped profile 2,2' is provided with several through holes, each through hole is provided with a pipe 3,3' and a supporting rod 4 is provided inside each pipe 3,3', in the length direction of the profile. This view is shown without the flexible element 5, so that the supporting rods 4 are easily visible, in practice, the flexible element 5 is placed on top of the supporting rods 4 as shown in the previous figures. Each pipe 3,3' is further provided with a spring element 6,6'. In this embodiment, it is further shown that some of the spring elements 6' are contracted, which is a result of the supporting rod 4 is pushed against the spring element, forcing the spring element to compress and thereby centre the supporting rod, especially during expansion.

Although this specific embodiment shows a device having five supporting rods 4, it is not meant to be limiting, the number of supporting rods, and hence length of the U-shaped profiles 2,2' can be adapted to the width of the bridge/road parts that are to be joined, end-to-end by placing several devices after each other.

FIG. 8 shows a perspective view of a roadway expansion joint device where each U-shaped profile 2,2' is provided with several through holes. However, in this embodiment every other through hole is in the first U-shaped profile 2 and every other is in the second U-shaped profile 2'. The first U-shaped profile 2 is provided with through holes, 23,24, a pipe 3 is provided inside and out of the through holes 23,24, a spring element 6 is provided in the end of the pipe extending out of the second upwards extending leg 22 of the U-shaped profile 2 and a supporting rod 4 is provided inside the pipe 3. The second U-shaped profile 2' do not have a corresponding through hole, which means that the supporting rod 4 will rest, and be pushed by the spring force from the spring element 6, against the first upwards extending leg 21' of the second U-shaped profile 2'. The second supporting rod 4' is instead provided inside a pipe 3' provided through the through holes 23',24' of the respective upwards extending legs 21',22' of the second U-shaped profile 2'. A spring element 6' is provided inside the pipe 3', which spring element 6' is provided in the end of the pipe that extends out of the through hole in the second upwards extending leg 22'. The first U-shaped profile 2 do not have a corresponding through hole, which means that the supporting rod 104 will be pressed against the first upwards extending leg 21 of the first U-shaped profile 2. The distance between each supporting rod can be adapted to the construction but is typically approx. 100 mm.

In the embodiment shown in FIG. 8, there are five supporting rods 4;4' provided, each extending from a pipe 3;3'. In this embodiment wherein the first, third and fifth supporting rod 4, counted from the front of the figure, extends from a pipe 3 provided in the first U-shaped profile 2, up to and towards the second U-shaped profile 2', while the second and fourth supporting rod 4' extends from a second and fourth pipe 3', provided in the second U-shaped profile 2', up to and towards the first U-shaped profile 2.

The roadway expansion joint device is here shown for installation in a new production where the conditions are often that each bridge side is cast on separate occasions, which is why fitting the supporting rod to the respective pipe 3,3' would be difficult. The embodiment in FIG. 8 solves this by letting one end of the supporting rod rest against the upwards extending leg of one of the profiles, instead of having to fit it through holes. Each supporting rod 4 is under constant pressure, as shown by arrows J in FIG. 8, against the opposing U-shaped profile 2,2', which pressure is created from a spring element 6,6' provided inside each pipe 3,3', in its rear part.

Although this specific embodiment shows a device having five supporting rods, 4; 4 it is not meant to be limiting, the number of supporting rods, and hence length of the U-shaped profiles 2,2' can be adapted to the length of the bridge/road parts that are to be joined by the roadway joint device. It is also possible to place several joint lengths after each other, depending on how the bridge is projected.

FIG. 9 shows a non-limiting example of a roadway expansion joint device according to the invention, mounted between two bridge slabs in a roadway construction. Although this is only shown for U-shaped profiles, the person skilled in the art understands that also other profiles can be used, such as for example I-shaped and L-shaped profiles.

Each of the U-shaped profiles 2,2' is attached to the bridge slab 10 by fastening bolts 8, protruding the U-shaped profiles 2,2' and extending into the bridge slab 10. Embedding grout 7 (or other suitable material) is added to keep the device in the correct place. A sealing rubber membrane 11 is typically, but not necessarily, provided under the device 1, as is well known in the art, and is normally glued to each of the U-shaped profiles with e.g., epoxy glue or other suitable fastening means. The roadway 9 is then constructed above the roadway expansion joint device.

In another, not shown, embodiment it is also possible to have one or both the U-shaped profiles 2,2' embedded in a further rubber element (not shown). This will further strengthen the construction. As mentioned above, it is also possible to have other shapes of the profiles.

The person skilled in the art understands that also other ways of attaching the roadway expansion joint device to bridge slabs, or roadway, such as attaching by chemical means, embedded in for example epoxy grout or other ways commonly known in the art, can be used. It is also possible to use other mechanical fasteners than expander bolts. The fasteners are typically chosen to give a good fastening/attachment to the material it is to be mounted in or on.

The expansion joint device 1 described herein allows quick assembly on site compared to the dominant constructions on the market today which are mostly made of steel, whose dimensioning makes the construction heavy and therefore usually requires lifting devices.

When an existing bridge/road joint needs to be replaced, depending on e.g., wear or damage in the joint the roadway expansion joint device described herein allows a prefabrication level fully adapted to range conditions and requirements to be a joint that can be lifted in and installed directly when the old joint part has been removed, which contributes to shorter interruptions to traffic. The expansion joint device described herein is less heavy than a lot of the devices currently used in the art and can hence be installed faster and more efficiently, both in new production and renovation, while at the same time a stronger and more durable construction is obtained compared to existing solutions.

Furthermore, adjustments can be done for the current joint opening with its existing bars pre-assembled. The current width of the joint opening is dependent on the current temperature with reference to calculations made during design.

The main purpose of the invention is to achieve a corrosion-free and strong construction with built-in bearing capacity of the soft, flexible motion-absorbing material and service life, for both smaller and larger joint openings. The device according to the claims contributes to an increased lifespan and longer service intervals, reduced environmental impact, minimized maintenance, lower weight as well as easier and faster installation. Overall, a more cost-effective design based on installation and service life.

What is claimed is:

1. A roadway expansion joint device comprising:

a first joint profile and a second joint profile arranged at a distance from each other so as to define a joint gap therebetween, each joint profile comprising an upwardly extending leg extending in a vertical direction from a horizontal portion, the upwardly extending leg comprising a through hole;

a first pipe extending from the through hole in the first joint profile, and a second pipe extending from the through hole of the second joint profile, each pipe extending in a direction away from the joint gap and comprising an internally tapered bore increasing in diameter from the respective joint profile toward an outer end of the pipe;

a supporting rod arranged within the first and second pipes and extending across the joint gap, the supporting rod being in clearance engagement with the internally tapered bores, being axially movable relative to the pipes and being permitted controlled transverse, angular and vertical movements relative to the joint profiles, the movement being defined by the internally tapered bores; and a flexible element arranged in the joint gap and being supported by the supporting rod, the flexible element comprising a solid motion-absorbing material.

2. The roadway expansion joint device of claim 1, wherein the first and second joint profiles are L-shaped profiles having a horizontal part extending out from the upwardly extending leg, to form an L-shape.

3. The roadway expansion joint device of claim 1, wherein the first and second joint profiles are U-shaped profiles having an intermediate horizontal part extending out from the upwardly extending leg, and a second upwardly extending leg, to form a U-shape;

wherein the second upwardly extending leg comprises a through hole, and wherein the pipe continues into the through hole of the second upwardly extending leg.

4. The roadway expansion joint device of claim 1, further comprising a spring element arranged inside the pipes.

5. The roadway expansion joint device of claim 1, wherein the pipe has a circular cross section.

6. The roadway expansion joint device of claim 1, wherein the diameter of the pipes is at least 1.5 times larger than the diameter of the supporting rod.

7. The roadway expansion joint device of claim 1, wherein the first and second joint profiles are made of: a composite material, carbon fiber, glass fiber reinforced plastic or a metal.

8. The roadway expansion joint device of claim 1, wherein the pipe and the supporting rod are made of a composite material, carbon fiber or glass fiber reinforced plastic.

9. Use of a roadway expansion joint device of claim 1 to join two bridge parts.

* * * * *